US009920400B2

(12) United States Patent
Na et al.

(10) Patent No.: US 9,920,400 B2
(45) Date of Patent: Mar. 20, 2018

(54) BULK NICKEL-BASED GLASSES BEARING CHROMIUM, NIOBIUM, PHOSPHORUS AND SILICON

(71) Applicant: Glassimetal Technology, Inc., Pasedena, CA (US)

(72) Inventors: Jong Hyun Na, Pasadena, CA (US); Michael Floyd, Pasadena, CA (US); Danielle Duggins, Garden Grove, CA (US); Glenn Garrett, Pasadena, CA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 489 days.

(21) Appl. No.: 14/565,219

(22) Filed: Dec. 9, 2014

(65) Prior Publication Data

US 2015/0159242 A1 Jun. 11, 2015

Related U.S. Application Data

(60) Provisional application No. 61/913,684, filed on Dec. 9, 2013.

(51) Int. Cl.

| | |
|---|---|
| ***C22C 19/05*** | (2006.01) |
| ***C22C 1/00*** | (2006.01) |
| ***C22C 45/04*** | (2006.01) |

(52) U.S. Cl.

CPC ..... *C22C 19/058* (2013.01); *C22C 1/002* (2013.01); *C22C 45/04* (2013.01); *C22C 19/056* (2013.01)

(58) Field of Classification Search

CPC ..... C22C 19/058; C22C 1/002; C22C 45/04; C22C 19/051

See application file for complete search history.

(56) References Cited

U.S. PATENT DOCUMENTS

| | | | |
|---|---|---|---|
| 3,856,513 | A | 12/1974 | Chen et al. |
| 4,116,682 | A | 9/1978 | Polk et al. |
| 4,126,284 | A | 11/1978 | Ichikawa et al. |
| 4,144,058 | A | 3/1979 | Chen et al. |
| 4,152,144 | A | 5/1979 | Hasegawa et al. |
| 4,385,932 | A | 5/1983 | Inomata et al. |
| 4,385,944 | A | 5/1983 | Hasegawa |
| 4,582,536 | A | 4/1986 | Raybould |
| 4,892,628 | A | 1/1990 | Guilinger |
| 4,900,638 | A | 2/1990 | Emmerich |
| 4,968,363 | A | 11/1990 | Hashimoto et al. |
| 5,338,376 | A | 8/1994 | Liu et al. |
| 5,429,725 | A | 7/1995 | Thorpe et al. |
| 5,634,989 | A | 6/1997 | Hashimoto et al. |
| 6,004,661 | A | 12/1999 | Sakai et al. |
| 6,303,015 | B1 | 10/2001 | Thorpe et al. |
| 6,325,868 | B1 | 12/2001 | Kim et al. |
| 6,695,936 | B2 | 2/2004 | Johnson |
| 8,052,923 | B2 | 11/2011 | Langlet |
| 8,287,664 | B2 | 10/2012 | Brunner |
| 9,085,814 | B2 * | 7/2015 | Na ..... C22C 1/002 |
| 2005/0263216 | A1 | 12/2005 | Chin et al. |
| 2006/0213586 | A1 | 9/2006 | Kui |
| 2007/0175545 | A1 | 8/2007 | Urata et al. |
| 2009/0110955 | A1 | 4/2009 | Hartman et al. |
| 2012/0073710 | A1 | 3/2012 | Kim et al. |
| 2012/0168037 | A1 | 7/2012 | Demetriou et al. |
| 2013/0048152 | A1 | 2/2013 | Na et al. |
| 2013/0263973 | A1 | 10/2013 | Kurahashi et al. |
| 2014/0076467 | A1 | 3/2014 | Na et al. |
| 2014/0096873 | A1 | 4/2014 | Na et al. |
| 2014/0116579 | A1 | 5/2014 | Na et al. |
| 2014/0130942 | A1 | 5/2014 | Floyd et al. |
| 2014/0130945 | A1 | 5/2014 | Na et al. |
| 2014/0190593 | A1 | 7/2014 | Na et al. |
| 2014/0213384 | A1 | 7/2014 | Johnson et al. |
| 2014/0238551 | A1 | 8/2014 | Na et al. |
| 2015/0047755 | A1 | 2/2015 | Na et al. |
| 2015/0158126 | A1 | 6/2015 | Hartmann et al. |
| 2015/0176111 | A1 | 6/2015 | Na et al. |
| 2015/0197837 | A9 | 7/2015 | Schramm et al. |
| 2015/0240336 | A1 | 8/2015 | Na et al. |

FOREIGN PATENT DOCUMENTS

| | | |
|---|---|---|
| CN | 1354274 | 6/2002 |
| CN | 1653200 | 8/2005 |

OTHER PUBLICATIONS

Habazaki et al., "Corrosion behaviour of amorphous Ni—Cr—Nb—P—B bulk alloys in 6M HCI solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

Park T.G. et al., "Development of new Ni-based amorphous alloys containing no metalloid that have large undercooled liquid regions," *Scripta Materialia*, vol. 43, No. 2, 2000, pp. 109-114.

Mitsuhashi A. et al., "The corrosion behavior of amorphous nickel base alloys in a hot concentrated phosphoric acid," *Corrosion Science*, vol. 27, No. 9, 1987, pp. 957-970.

(Continued)

*Primary Examiner* — Jessee Roe

(74) *Attorney, Agent, or Firm* — Polsinelli PC

(57) ABSTRACT

The disclosure is directed to Ni—Cr—P eutectic alloys bearing Nb as substitution for Cr that are capable of forming metallic glasses with critical rod diameter of at least 1 mm or more. With further minority addition of Si as replacement for P, such alloys are capable of forming metallic glasses with critical rod diameters as high as 10 mm or more. Specifically, Ni-based compositions with a Cr content of between 5 and 14 atomic percent, Nb content of between 3 and 4 atomic percent, P content of between 17.5 and 19 atomic percent, and Si content of between 1 and 2 atomic percent, were capable of forming bulk metallic glass rods with diameters as large as 6 mm or larger.

20 Claims, 15 Drawing Sheets

(56) References Cited

FOREIGN PATENT DOCUMENTS

| | | |
|---|---|---|
| DE | 3929222 | 3/1991 |
| DE | 10 2011 001 784 | 10/2012 |
| DE | 102011001783 | 10/2012 |
| EP | 0014335 | 8/1980 |
| EP | 0161393 | 11/1985 |
| EP | 0260706 | 3/1988 |
| EP | 1077272 | 2/2001 |
| EP | 1108796 | 6/2001 |
| EP | 1522602 | 4/2005 |
| JP | 54-76423 | 6/1979 |
| JP | S55-148752 | 11/1980 |
| JP | S57-13146 | 1/1982 |
| JP | 63-079930 | 4/1988 |
| JP | 63-079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

Kawashima A. et al., "Change in corrosion behavior of amorphous Ni—P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

U.S. Appl. No. 14/824,733, filed Aug. 12, 2015, Na et al.

U.S. Appl. No. 14/797,878, filed Jul. 13, 2015, Na et al.

Habazaki et al., "Preparation of corrosion-resistant amorphous Ni—Cr—P—B bulk alloys containing molybdenum and tantalum," *Material Science and Engineering*, A304-306, 2001, pp. 696-700.

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," *Corrosion Science*, vol. 43, No. 1, pp. 183-191, 2001.

* cited by examiner

BULK NICKEL-BASED GLASSES BEARING CHROMIUM, NIOBIUM, PHOSPHORUS AND SILICON

CROSS-REFERENCE TO RELATED APPLICATIONS

The present application claims the benefit of U.S. Provisional Patent Application No. 61/913,684, entitled "Bulk Nickel-Based Glasses Bearing Chromium, Niobium, Phosphorus and Silicon", filed on Dec. 9, 2013, which is incorporated herein by reference in its entirety.

FIELD

The disclosure relates to Ni—Cr—Nb—P and Ni—Cr—Nb—P—Si alloys that are capable of forming bulk metallic glass and have critical rod diameters greater than 1 mm and as large as 10 mm or larger.

BACKGROUND

Ni-based bulk-glass forming alloys bearing P capable of forming glassy rods with diameters of several millimeters and up to one centimeter or more have recently been disclosed. Bulk-glass forming Ni—Cr—Nb—P—B alloys have been disclosed in the following recent applications: U.S. patent application Ser. No. 13/592,095, entitled "Bulk Nickel-Based Chromium and Phosphorous Bearing Metallic Glasses", filed on Aug. 22, 2012, and U.S. patent application Ser. No. 14/067,521, entitled "Bulk Nickel-Based Chromium and Phosphorous Bearing Metallic Glasses with High Toughness", filed on Oct. 30, 2013, the disclosures of which are incorporated herein by reference in their entirety. Bulk-glass forming Ni—Mo—Nb—P—B alloys have been disclosed in the following recent applications: U.S. patent application Ser. No. 14/048,894, entitled "Bulk Nickel-Phosphorous-Boron Glasses Bearing Molybdenum," filed on Oct. 8, 2013, the disclosures of which are incorporated herein by reference in their entirety. Bulk-glass forming Ni—Cr—Ta—P—B alloys have been disclosed in U.S. patent application Ser. No. 14/081,622, entitled "Bulk Nickel-Phosphorous-Boron Glasses Bearing Chromium and Tantalum," filed on Nov. 15, 2013, the disclosure of which is incorporated herein by reference in its entirety. Bulk-glass forming Ni—Cr—Mn—P—B alloys have been disclosed in U.S. Patent Application No. 61/769,707, entitled "Bulk Nickel-Phosphorous-Boron Glasses Bearing Chromium and Manganese," filed on Feb. 26, 2013, the disclosure of which is incorporated herein by reference in its entirety. Bulk-glass forming Ni—Mn—Nb—P—B alloys have been disclosed in U.S. Patent Application No. 61/866,743, entitled "Bulk Nickel-Phosphorus-Boron Glasses Bearing Manganese and Niobium," filed on Aug. 16, 2013, the disclosure of which is incorporated herein by reference in its entirety.

The bulk-glass-forming alloys disclosed in the aforementioned applications include B in their composition. B is an expensive element, and is considered the main cost driver of those compositions. The aforementioned applications do not disclose how one can arrive at a Ni-based P-bearing bulk-glass-forming alloy that is free of B.

Japanese Patents JP63-79930 and JP63-79931 (the disclosures of which are incorporated herein by reference) are broadly directed to Ni-based P-bearing corrosion-resistant metallic glasses, including some B-free compositions. However, the references only disclose, in part, the formation of foils processed by rapid solidification, and do not describe how one can arrive at specific compositions requiring low cooling rates to form glass such that they are capable of forming bulk metallic glasses having thickness of up to a centimeter or more, nor do they propose that the formation of such bulk glasses is even possible. There remains a need for developing bulk metallic glasses free of boron.

BRIEF SUMMARY

In the disclosure, Ni—Cr—Nb—P and Ni—Cr—Nb—P—Si alloys are disclosed capable of forming bulk metallic glass and have critical rod diameters greater than 1 mm and as large as 10 mm or larger.

The disclosure is directed to an alloy or metallic glass represented by the following formula (subscripts denote atomic percent):

$$Ni_{(100-a-b-c-d)}Cr_aNb_bP_cSi_d \quad (1)$$

where:

a is between 2 and 18, b is between 1 and 6, c is between 16 and 20, and d is up to 4.

In various aspects, the critical rod diameter of the alloy is at least 1 mm.

The disclosure is also directed to a metallic glass comprising an alloy represented by the following formula (subscripts denote atomic percent):

$$Ni_{(100-a-b-c-d)}Cr_aNb_bP_cSi_d \quad (1)$$

where:

a is between 2 and 18, b is between 1 and 6, c is between 16 and 20, and d is up to 4, and wherein the metallic glass can be formed into an object that has a lateral dimension of at least 1 mm.

In another embodiment, a is between 3 and 16, b is between 2 and 5, c is between 16.5 to 19.5, and d is up to 3. In such embodiments, the critical rod diameter of the alloy is at least 3 mm.

In another embodiment, a is between 4 and 14, b is between 2.5 and 4.5, c is between 17.5 and 19, and d is between 0.5 and 2.5. In such embodiments, the critical rod diameter of the alloy is at least 5 mm.

In another embodiment, a is between 5 and 7, b is between 2.5 and 4.5, c is between 17.5 and 19, and d is between 0.5 and 2.5. In such embodiments, the critical rod diameter of the alloy is at least 6 mm.

In another embodiment, a is between 8 and 13, b is between 2.5 and 4.5, c is between 17.5 and 19, and d is between 0.5 and 2.5. In such embodiments, the critical rod diameter of the alloy is at least 6 mm.

In another embodiment, a is between 9 and 12, b is between 3 and 4, c is between 17.5 and 18.5, and d is between 1 and 2. In such embodiments, the critical rod diameter of the alloy is at least 8 mm.

In another embodiment, the sum of c and d is between 18.5 and 21. In such embodiments, the critical rod diameter of the alloy is at least 3 mm.

In another embodiment, the sum of c and d is between 19 and 20. In such embodiments, the critical rod diameter of the alloy is at least 6 mm.

In yet another embodiment, up to 30 atomic percent of Ni is substituted by Co.

In yet another embodiment, up to 10 atomic percent of Ni is substituted by Fe.

In yet another embodiment, up to 5 atomic percent of Ni is substituted by Cu.

In yet another embodiment, up to 2 atomic percent of Cr is substituted by Mo, Mn, Fe, Co, W, Ru, Re, Cu, Pd, Pt, or combinations thereof.

In yet another embodiment, up to 1 atomic % of Nb is substituted by Mo, Mn, Ta, or V, or combinations thereof.

In yet another embodiment, the melt is fluxed with a fluxing agent prior to rapid quenching.

In yet another embodiment, the melt is fluxed with a boron oxide prior to rapid quenching.

In yet another embodiment, the temperature of the melt prior to quenching is at least 200 degrees above the liquidus temperature of the alloy.

In yet another embodiment, the temperature of the melt prior to quenching is at least 1200° C.

In yet another embodiment, the notch toughness, defined as the stress intensity at crack initiation when measured on a 3 mm diameter rod containing a notch with length between 1 and 2 mm and root radius between 0.1 and 0.15 mm, is at least 60 MPa $m^{1/2}$.

In yet another embodiment, a wire made of such metallic glass having a diameter of 1 mm can undergo macroscopic plastic deformation under bending load without fracturing catastrophically.

The disclosure is also directed to a metallic glass having alloy composition $Ni_{71.5}Cr_{5.6}Nb_{3.4}P_{18.5}Si_1$, $Ni_{71.5}Cr_{5.6}Nb_{3.4}P_{18}Si_{1.5}$, $Ni_{71.5}Cr_{5.6}Nb_{3.4}P_{17.5}Si_2$, $Ni_{71.5}Cr_6Nb_3P_{18}Si_{1.5}$, $Ni_{71.9}Cr_{5.6}Nb_3P_{18}Si_{1.5}$, $Ni_{70.9}Cr_{5.6}Nb_4P_{18}Si_{1.5}$, $Ni_{71.06}Cr_{5.56}Nb_{3.38}P_{18.46}Si_{1.54}$, $Ni_{70.1}Cr_7Nb_{3.4}P_{18}Si_{1.5}$, $Ni_{69.1}Cr_8Nb_{3.4}P_{18}Si_{1.5}$, $Ni_{72.1}Cr_5Nb_{3.4}P_{18}Si_{1.5}$, $Ni_{71.1}Cr_6Nb_{3.4}P_{18}Si_{1.5}$, $Ni_{68.1}Cr_9Nb_{3.4}P_{18}Si_{1.5}$, $Ni_{67.1}Cr_{10}Nb_{3.4}P_{18}Si_{1.5}$, $Ni_{66.1}Cr_{11}Nb_{3.4}P_{18}Si_{1.5}$, $Ni_{65.1}Cr_{12}Nb_{3.4}P_{18}Si_{1.5}$, and $Ni_{64.1}Cr_{13}Nb_{3.4}P_{18}Si_{1.5}$.

The disclosure is further directed to alloy compositions $Ni_{71.5}Cr_{5.6}Nb_{3.4}P_{18.5}Si_1$, $Ni_{71.5}Cr_{5.6}Nb_{3.4}P_{18}Si_{1.5}$, $Ni_{71.5}Cr_{5.6}Nb_{3.4}P_{17.5}Si_2$, $Ni_{71.5}Cr_6Nb_3P_{18}Si_{1.5}$, $Ni_{71.9}Cr_{5.6}Nb_3P_{18}Si_{1.5}$, $Ni_{70.9}Cr_{5.6}Nb_4P_{18}Si_{1.5}$, $Ni_{71.06}Cr_{5.56}Nb_{3.38}P_{18.46}Si_{1.54}$, $Ni_{70.1}Cr_7Nb_{3.4}P_{18}Si_{1.5}$, $Ni_{69.1}Cr_8Nb_{3.4}P_{18}Si_{1.5}$, $Ni_{72.1}Cr_5Nb_{3.4}P_{18}Si_{1.5}$, $Ni_{71.1}Cr_6Nb_{3.4}P_{18}Si_{1.5}$, $Ni_{68.1}Cr_9Nb_{3.4}P_{18}Si_{1.5}$, $Ni_{67.1}Cr_{10}Nb_{3.4}P_{18}Si_{1.5}$, $Ni_{66.1}Cr_{11}Nb_{3.4}P_{18}Si_{1.5}$, $Ni_{65.1}Cr_{12}Nb_{3.4}P_{18}Si_{1.5}$, and $Ni_{64.1}Cr_{13}Nb_{3.4}P_{18}Si_{1.5}$.

Additional embodiments and features are set forth in part in the description that follows, and in part will become apparent to those skilled in the art upon examination of the specification or may be learned by the practice of the embodiments discussed herein. A further understanding of the nature and advantages of certain embodiments may be realized by reference to the remaining portions of the specification and the drawings, which form a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION

Figure 1:
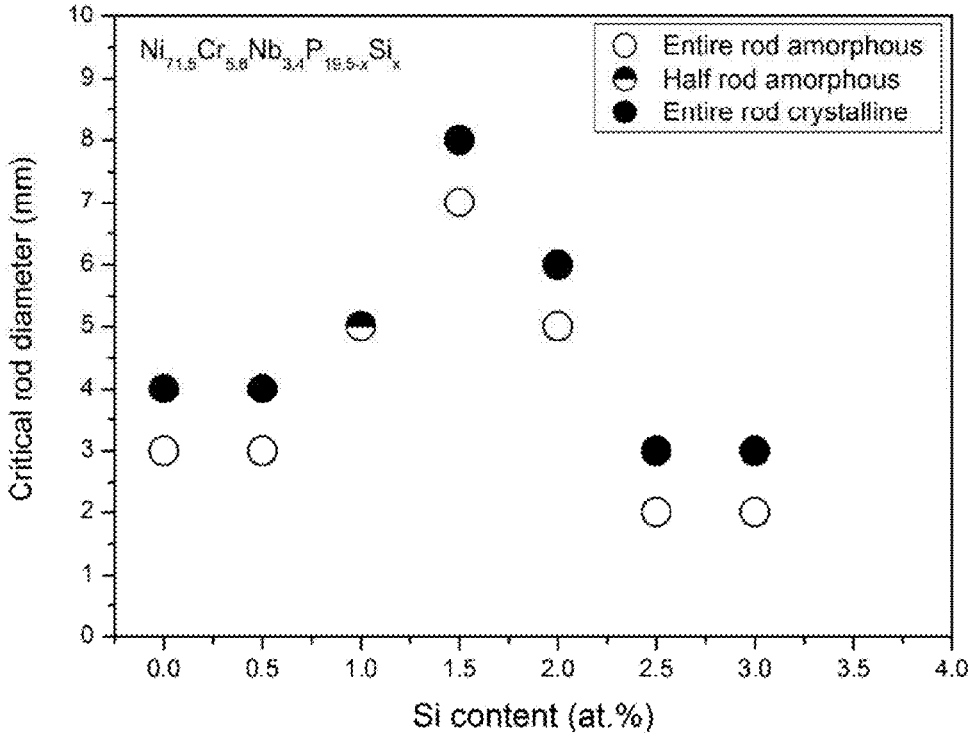
FIG. 1 provides a plot showing the effect of substituting P by Si on the glass forming ability of $Ni_{71.5}Cr_{5.6}Nb_{3.4}P_{19.5-x}Si_x$ alloy, in accordance with embodiments of the disclosure.

The disclosure is directed to alloys, metallic glasses, and methods of making and using the same. In some aspects, the alloys are described as capable of forming metallic glasses having certain characteristics. It is intended, and will be understood by those skilled in the art, that the disclosure is also directed to metallic glasses having the composition of the disclosed alloys described herein in all instances.

Definitions

In the disclosure, the term "entirely free" of an element means not more than amounts of the element found in naturally occurring trace amounts.

The glass-forming ability of each alloy can be quantified by the "critical rod diameter," defined as the largest rod diameter in which the amorphous phase (i.e. the metallic glass) can be formed when processed with a method of water quenching a quartz tube with 0.5 mm thick wall containing a molten alloy.

A "critical cooling rate," which is defined as the cooling rate required to avoid crystallization and form the amorphous phase of the alloy (i.e. the metallic glass), determines the critical rod diameter. The lower the critical cooling rate of an alloy, the larger its critical rod diameter. The critical cooling rate $R_c$ in K/s and critical rod diameter $d_c$ in mm are related via the following approximate empirical formula:

$$R_c=1000/d_c^2 \quad \text{Eq. (2)}$$

According to Eq. (2), the critical cooling rate for an alloy having a critical rod diameter of about 3 mm, as in the case of the alloys according to embodiments of the disclosure, is only about $10^2$ K/s.

Generally, three categories are known in the art for identifying the ability of an alloy to form glass (i.e. to bypass the stable crystal phase and form an amorphous phase). Alloys having critical cooling rates in excess of $10^{12}$ K/s are typically referred to as non-glass formers, as it is physically impossible to achieve such cooling rates over a meaningful thickness (i.e. at least 1 micrometer). Alloys having critical cooling rates in the range of $10^5$ to $10^{12}$ K/s are typically referred to as marginal glass formers, as they are able to form glass over thicknesses ranging from 1 to 100 micrometers according to Eq. (2). Alloys having critical cooling rates on the order of $10^3$ or less, and as low as 1 or 0.1 K/s, are typically referred to as bulk glass formers, as they are able to form glass over thicknesses ranging from 1 millimeter to several centimeters. The glass-forming ability of a metallic alloy is, to a very large extent, dependent on the composition of the alloy. The compositional ranges for alloys capable of forming marginal glass formers are considerably broader than those for forming bulk glass formers.

The "notch toughness" is defined as the stress intensity factor at crack initiation $K_q$ when measured on a 3 mm diameter rod containing a notch with length ranging from 1 to 2 mm and root radius ranging from 0.1 to 0.15 mm. Notch toughness is the measure of the material's ability to resist fracture in the presence of a notch. The notch toughness is a measure of the work required to propagate a crack originating from a notch. A high $K_q$ ensures that the material will be tough in the presence of defects.

The "compressive yield strength," $\sigma_y$, is the measure of the material's ability to resist non-elastic yielding. The yield strength is the stress at which the material yields plastically. A high $\sigma_y$ ensures that the material will be strong.

The plastic zone radius, $r_p$, defined as $K_q^2/\pi\sigma_y^2$, where $\sigma_y$ is the compressive yield strength, is a measure of the critical flaw size at which catastrophic fracture is promoted. The plastic zone radius determines the sensitivity of the material to flaws; a high $r_p$ designates a low sensitivity of the material to flaws.

Bending ductility is a measure of the material's ability to deform plastically and resist fracture in bending in the absence of a notch or a pre-crack. A high bending ductility ensures that the material will be ductile in a bending overload.

Description of Metallic Glasses and Alloy Compositions

Many bulk Ni-rich alloys based on the ternary Ni—P—B with minority additions of Cr, Nb, Mo, Mn, and Ta have recently been discovered and disclosed in several recent disclosures. In order to form a bulk glass (defined as forming metallic glass rods with diameters of at least 1 mm), all of the previously disclosed alloy compositions require B at atomic concentration of at least 1% and typically up to 5%, and in most embodiments between 2 and 4%. B is an expensive element, and represents the cost driver in most of those alloys. Hence discovering bulk Ni-based glasses free of B is of technological importance.

In the disclosure, it was discovered that Ni—Cr—P eutectic alloys bearing Nb as a substitution for Cr are capable of forming metallic glasses with critical rod diameter of at least 1 mm or more. Moreover, with minority additions of Si as a replacement for P, such alloys are capable of forming metallic glasses with critical rod diameters as high as 10 mm or more. Specifically, Ni-based compositions with a Cr content of between 5 and 14 atomic percent, Nb content of between 3 and 4 atomic percent, P content of between 17.5 and 19 atomic percent, and Si content of between 1 and 2 atomic percent, were capable of forming bulk metallic glass rods with diameters as large as 6 mm or larger.

Figure 2:
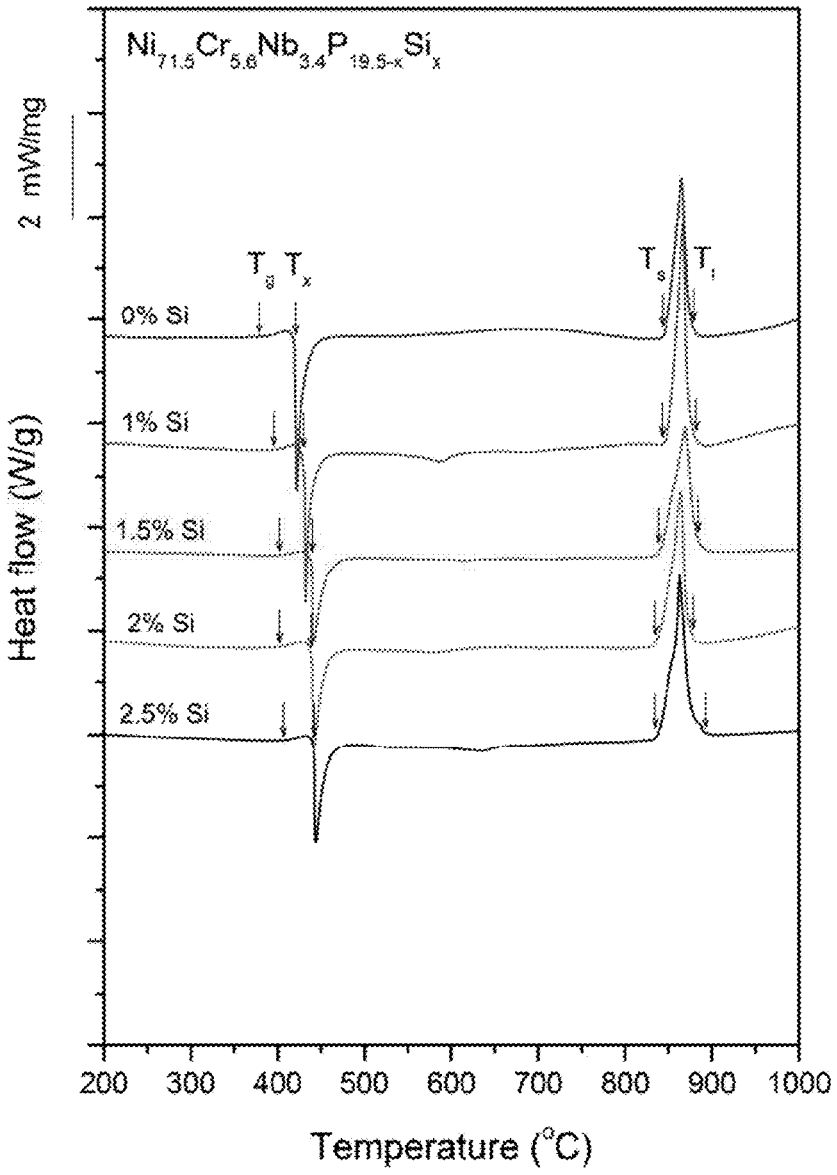
FIG. 2 provides a plot showing calorimetry scans at a heating rate of 20 K/min for sample metallic glass $Ni_{71.5}Cr_{5.6}Nb_{3.4}P_{19.5-x}Si_x$ in accordance with embodiments of the disclosure. Arrows from left to right designate the glass-transition, crystallization, solidus, and liquidus temperatures.

Sample metallic glasses showing the effect of substituting P by Si, according to the formula $Ni_{71.5}Cr_{5.6}Nb_{3.4}P_{19.5-x}Si_x$, are presented in Table 1 and FIG. 1. As shown, when the Si atomic percent is up to 3, metallic glass rods with diameters greater than 1 mm can be formed, when Si is between 0.5 and 2.5 metallic glass rods with diameters greater than 4 mm can be formed, when Si is between 1 and 2 metallic glass rods with diameters of at least 5 mm can be formed, when Si is between 1.25 and 1.75 metallic glass rods with diameters greater than 6 mm can be formed, while when the Si atomic percent is at about 1.5, metallic glass rods with a diameter of at least 7 mm can be formed. Differential calorimetry scans for example metallic glasses in which P is substituted by Si are presented in FIG. 2.

TABLE 1

Sample metallic glasses demonstrating the effect of increasing the Si atomic concentration at the expense of P on the glass forming ability of the Ni—Cr—Nb—P—Si alloy

| Example | Composition | Critical Rod Diameter [mm] |
|---|---|---|
| 1 | $Ni_{71.5}Cr_{5.6}Nb_{3.4}P_{19.5}$ | 3 |
| 2 | $Ni_{71.5}Cr_{5.6}Nb_{3.4}P_{19}Si_{0.5}$ | 3 |
| 3 | $Ni_{71.5}Cr_{5.6}Nb_{3.4}P_{18.5}Si_1$ | 5 |
| 4 | $Ni_{71.5}Cr_{5.6}Nb_{3.4}P_{18}Si_{1.5}$ | 7 |
| 5 | $Ni_{71.5}Cr_{5.6}Nb_{3.4}P_{17.5}Si_2$ | 5 |
| 6 | $Ni_{71.5}Cr_{5.6}Nb_{3.4}P_{17}Si_{2.5}$ | 2 |
| 7 | $Ni_{71.5}Cr_{5.6}Nb_{3.4}P_{16.5}Si_3$ | 2 |

Figure 3:
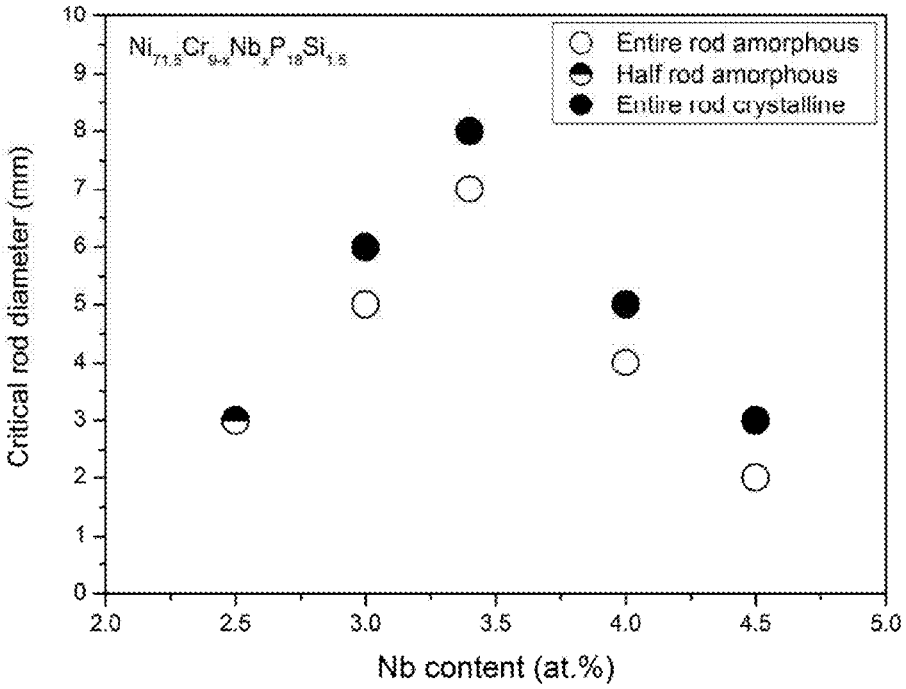
FIG. 3 provides a plot showing the effect of substituting Cr by Nb on the glass forming ability of $Ni_{71.5}Cr_{9-x}Nb_xP_{18}Si_{1.5}$ alloys, in accordance with embodiments of the disclosure.
Figure 4:
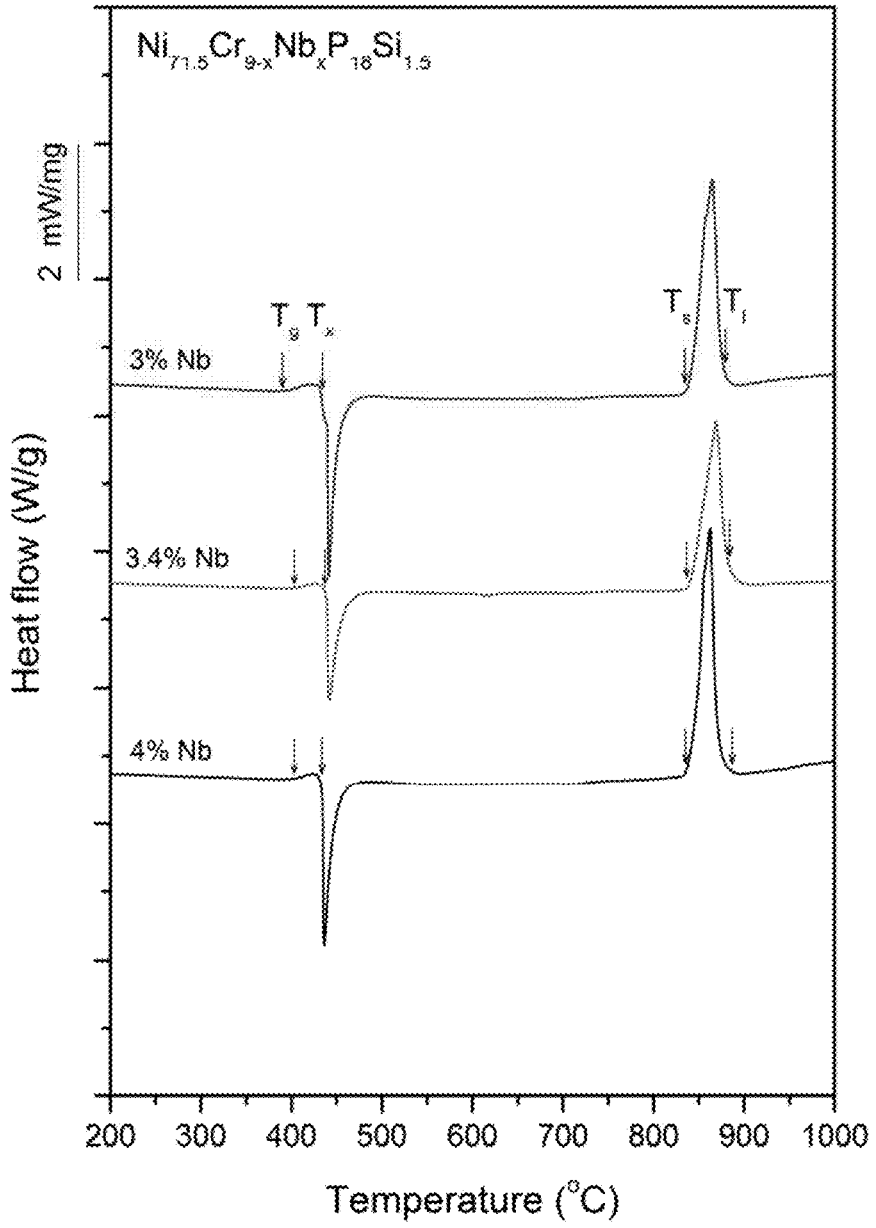
FIG. 4 provides a plot showing calorimetry scans at a heating rate of 20 K/min for sample metallic glass $Ni_{71.5}Cr_{9-x}Nb_xP_{18}Si_{1.5}$, in accordance with embodiments of the disclosure. Arrows from left to right designate the glass-transition, crystallization, solidus, and liquidus temperatures.

Sample metallic glasses showing the effect of substituting Cr by Nb, according to the formula $Ni_{71.5}Cr_{9-x}Nb_xP_{18}Si_{1.5}$, are presented in Table 2 and FIG. 3. As shown, when the Nb atomic percent is between 2.5 and 4, metallic glass rods with diameters of at least 3 mm can be formed, while when the Nb atomic percent is about 3.5, metallic glass rods with a diameter of at least 7 mm can be formed. Differential calorimetry scans for example metallic glasses in which Cr is substituted by Nb are presented in FIG. 4. ΔT (i.e. Tx-Tg) decreases with increasing Nb content.

TABLE 2

Sample metallic glasses demonstrating the effect of increasing the Nb atomic concentration at the expense of Cr on the glass forming ability of the Ni—Cr—Nb—P—Si alloy

| Example | Composition | Critical Rod Diameter [mm] |
|---|---|---|
| 8 | $Ni_{71.5}Cr_{6.5}Nb_{2.5}P_{18}Si_{1.5}$ | 3 |
| 9 | $Ni_{71.5}Cr_{6}Nb_{3}P_{18}Si_{1.5}$ | 5 |
| 4 | $Ni_{71.5}Cr_{5.6}Nb_{3.4}P_{18}Si_{1.5}$ | 7 |
| 10 | $Ni_{71.5}Cr_{5}Nb_{4}P_{18}Si_{1.5}$ | 4 |
| 11 | $Ni_{71.5}Cr_{4.5}Nb_{4.5}P_{18}Si_{1.5}$ | 2 |

Figure 5:
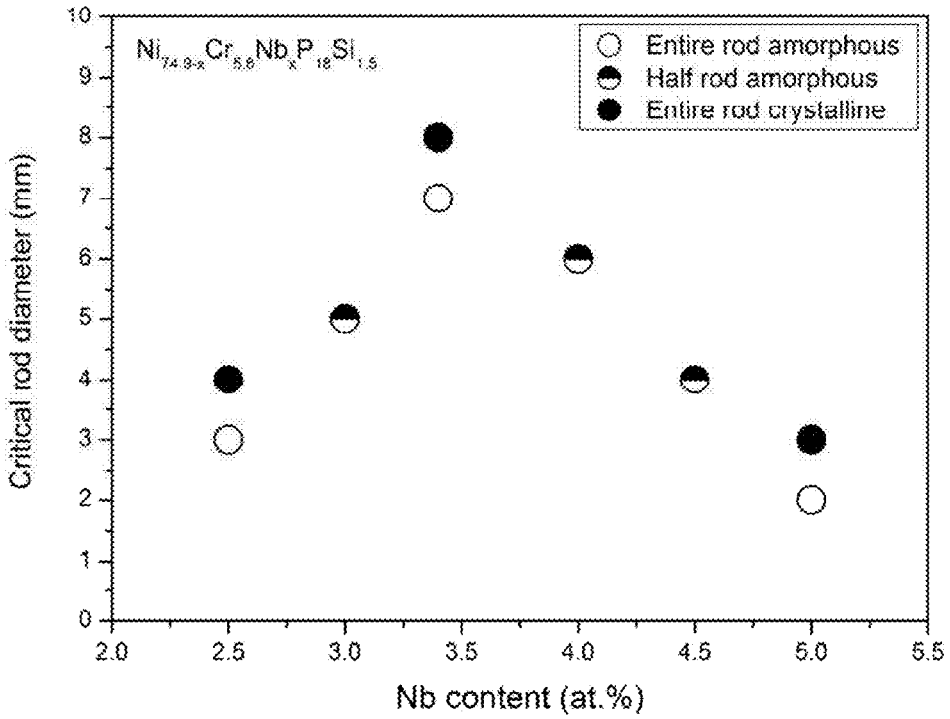
FIG. 5 provides a plot showing the effect of substituting Ni by Nb on the glass forming ability of $Ni_{74.9-x}Cr_{5.6}Nb_xP_{18}Si_{1.5}$ alloys, in accordance with embodiments of the disclosure.
Figure 6:
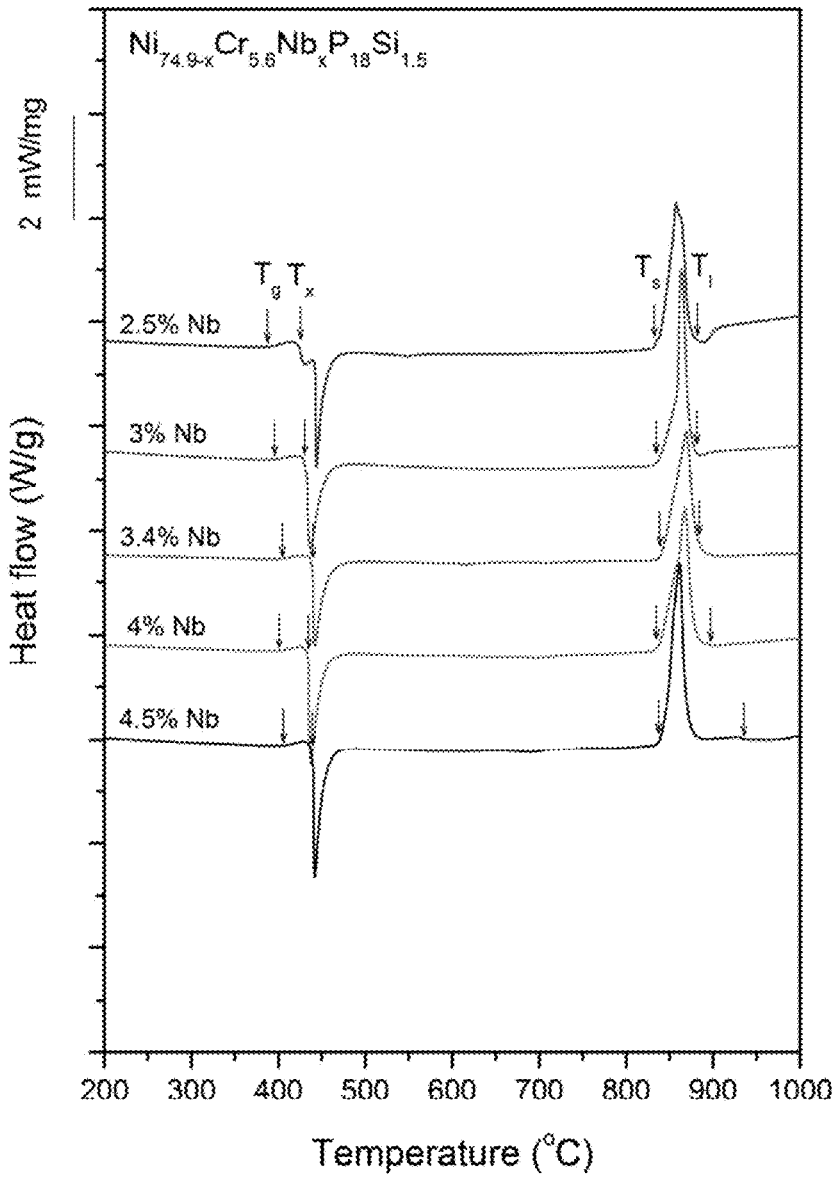
FIG. 6 provides a plot showing calorimetry scans at a heating rate of 20 K/min for sample metallic glass $Ni_{74.9-x}Cr_{5.6}Nb_xP_{18}Si_{1.5}$, in accordance with embodiments of the disclosure. Arrows from left to right designate the glass-transition, crystallization, solidus, and liquidus temperatures.

Sample metallic glasses showing the effect of substituting Ni by Nb, according to the formula $Ni_{74.9-x}Cr_{5.6}Nb_xP_{18}Si_{1.5}$, are presented in Table 3 and FIG. 5. As shown, when the Nb atomic percent is between 2.5 and 4.5, metallic glass rods with diameters greater than 3 mm can be formed, while when the Nb atomic percent is at about 3.5, metallic glass rods with a diameter of at least 7 mm can be formed. Differential calorimetry scans for example metallic glasses in which Ni is substituted by Nb are presented in FIG. 6.

TABLE 3

Sample metallic glasses demonstrating the effect of increasing the Nb atomic concentration at the expense of Ni on the glass forming ability of the Ni—Cr—Nb—P—Si alloy

| Example | Composition | Critical Rod Diameter [mm] |
|---|---|---|
| 12 | $Ni_{72.4}Cr_{5.6}Nb_{2.5}P_{18}Si_{1.5}$ | 3 |
| 13 | $Ni_{71.9}Cr_{5.6}Nb_{3}P_{18}Si_{1.5}$ | 5 |
| 4 | $Ni_{71.5}Cr_{5.6}Nb_{3.4}P_{18}Si_{1.5}$ | 7 |
| 14 | $Ni_{70.9}Cr_{5.6}Nb_{4}P_{18}Si_{1.5}$ | 6 |
| 15 | $Ni_{70.4}Cr_{5.6}Nb_{4.5}P_{18}Si_{1.5}$ | 4 |
| 16 | $Ni_{69.9}Cr_{5.6}Nb_{5}P_{18}Si_{1.5}$ | 2 |

Figure 7:
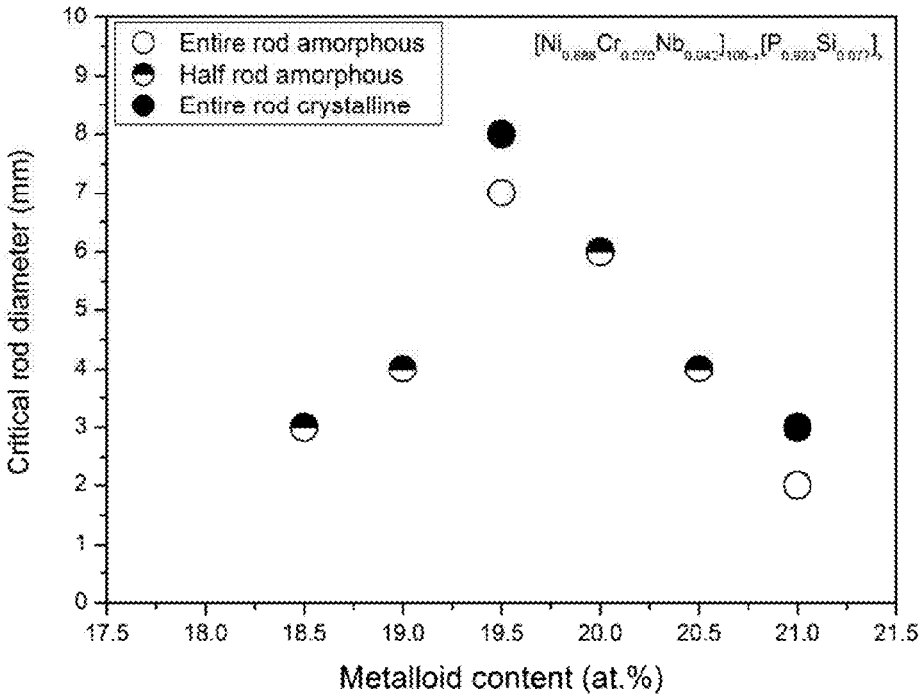
FIG. 7 provides a plot showing the effect of varying the metal to metalloid ratio, according to the formula $(Ni_{0.888}Cr_{0.070}Nb_{0.042})_{100-x}(P_{0.923}Si_{0.077})_x$, in accordance with embodiments of the disclosure.
Figure 8:
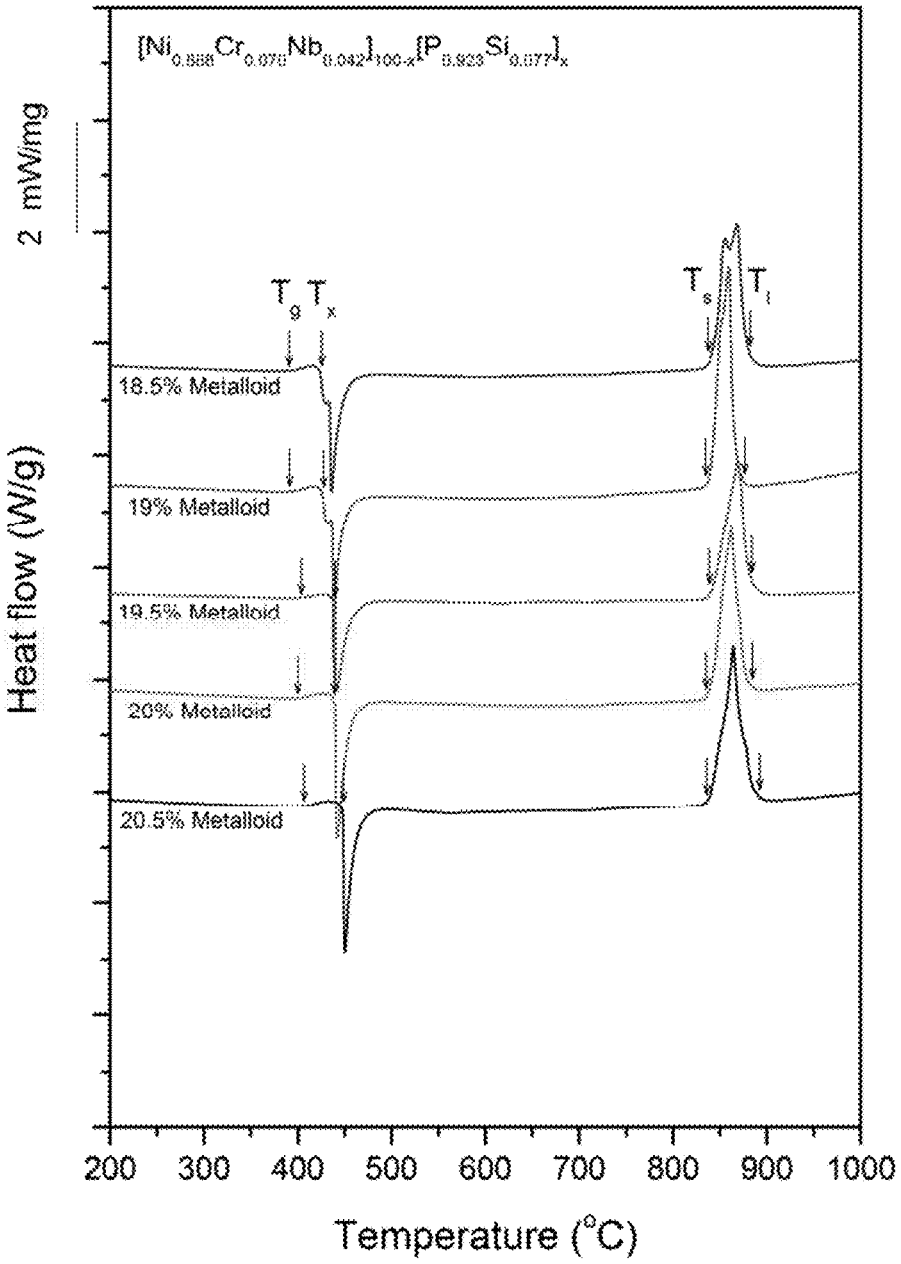
FIG. 8 provides a plot showing calorimetry scans at a heating rate of 20 K/min for sample metallic glass $(Ni_{0.888}Cr_{0.070}Nb_{0.042})_{100-x}(P_{0.923}Si_{0.077})_x$, in accordance with embodiments of the disclosure. Arrows from left to right designate the glass-transition, crystallization, solidus, and liquidus temperatures.

Sample metallic glasses showing the effect of varying the metal to metalloid ratio, according to the formula $(Ni_{0.888}Cr_{0.070}Nb_{0.042})_{100-x}(P_{0.923}Si_{0.077})_x$, are presented in Table 4 and FIG. 7. As shown, when the metalloid atomic percent x is between 18.5 and 20.5, metallic glass rods 3 mm in diameter can be formed, while when the metalloid atomic percent is about 19.5, metallic glass rods with a diameter of at least 7 mm can be formed. Differential calorimetry scans for example metallic glasses in which the metal to metalloid ratio is varied are presented in FIG. 8. ΔT (i.e. Tx-Tg) increases with increasing metalloid content.

TABLE 4

Sample metallic glasses demonstrating the effect of increasing the total metalloid concentration at the expense of metals on the glass forming ability of the Ni—Cr—Nb—P—Si alloy

| Example | Composition | Critical Rod Diameter [mm] |
|---|---|---|
| 17 | $Ni_{72.39}Cr_{5.67}Nb_{3.44}P_{17.08}Si_{1.42}$ | 3 |
| 18 | $Ni_{71.94}Cr_{5.64}Nb_{3.42}P_{17.54}Si_{1.46}$ | 4 |
| 4 | $Ni_{71.5}Cr_{5.6}Nb_{3.4}P_{18}Si_{1.5}$ | 7 |
| 19 | $Ni_{71.06}Cr_{5.56}Nb_{3.38}P_{18.46}Si_{1.54}$ | 6 |
| 20 | $Ni_{70.61}Cr_{5.53}Nb_{3.36}P_{18.92}Si_{1.58}$ | 4 |
| 21 | $Ni_{70.16}Cr_{5.50}Nb_{3.34}P_{19.38}Si_{1.62}$ | 2 |

Figure 9:
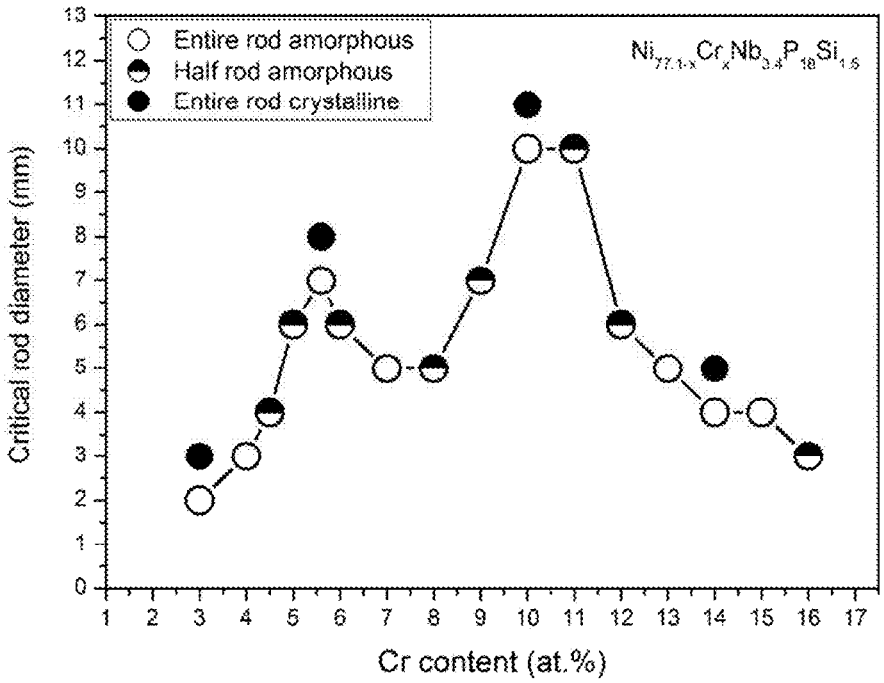
FIG. 9 provides a plot showing the effect of substituting Ni by Cr on the glass forming ability of $Ni_{77.1-x}Cr_xNb_{3.4}P_{18}Si_{1.5}$ alloys, in accordance with embodiments of the disclosure.
Figure 10:
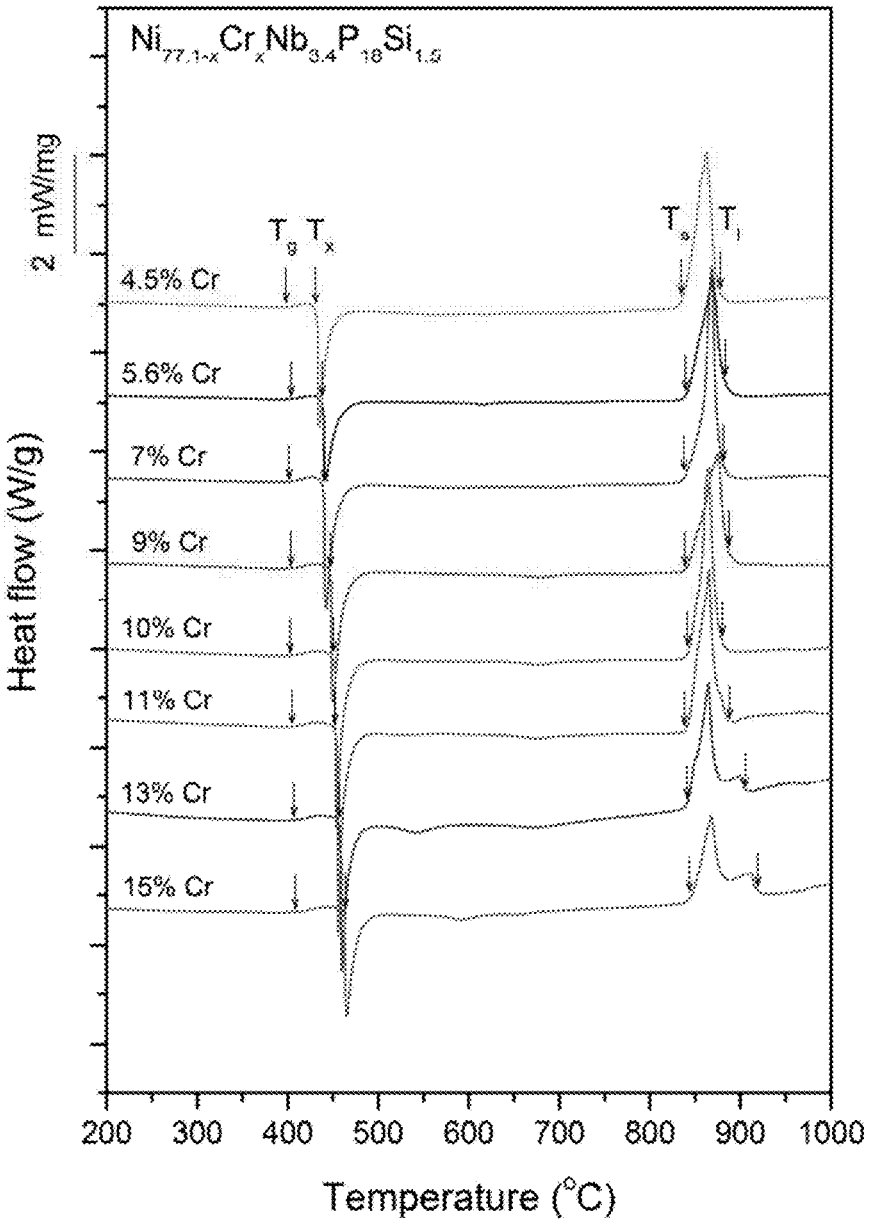
FIG. 10 provides a plot showing calorimetry scans at a heating rate of 20 K/min for sample metallic glass $Ni_{77.1-x}Cr_xNb_{3.4}P_{18}S_{1.5}$, in accordance with embodiments of the disclosure. Arrows from left to right designate the glass-transition, crystallization, solidus, and liquidus temperatures.

Sample metallic glasses showing the effect of substituting Ni by Cr, according to the formula $Ni_{77.1-x}Cr_xNb_{3.4}P_{18}Si_{1.5}$, are presented in Table 5 and FIG. 9. As shown, when the Cr atomic percent is between 4 and 16, metallic glass rods with diameters greater than 3 mm can be formed, when the Cr atomic percent is between 5 and 7 and between 8 and 13, metallic glass rods with a diameter of at least 6 mm can be formed, when the Cr atomic percent is between 9 and 12, metallic glass rods with diameters greater than 8 mm can be formed, while when the Cr atomic percent is at about 10, metallic glass rods with diameters of about 10 mm can be formed. Differential calorimetry scans for example metallic glasses in which Ni is substituted by Cr are presented in FIG. 10. ΔT (i.e. Tx-Tg) increases with increasing Cr content.

TABLE 5

Sample metallic glasses demonstrating the effect of increasing the Cr atomic concentration at the expense of Ni on the glass forming ability of the Ni—Cr—Nb—P—Si alloy

| Example | Composition | Critical Rod Diameter [mm] |
|---|---|---|
| 22 | $Ni_{74.1}Cr_{3}Nb_{3.4}P_{18}Si_{1.5}$ | 2 |
| 23 | $Ni_{73.1}Cr_{4}Nb_{3.4}P_{18}Si_{1.5}$ | 3 |
| 24 | $Ni_{72.6}Cr_{4.5}Nb_{3.4}P_{18}Si_{1.5}$ | 4 |
| 25 | $Ni_{72.1}Cr_{5}Nb_{3.4}P_{18}Si_{1.5}$ | 6 |
| 4 | $Ni_{71.5}Cr_{5.6}Nb_{3.4}P_{18}Si_{1.5}$ | 7 |
| 26 | $Ni_{71.1}Cr_{6}Nb_{3.4}P_{18}Si_{1.5}$ | 6 |
| 27 | $Ni_{70.1}Cr_{7}Nb_{3.4}P_{18}Si_{1.5}$ | 5 |
| 28 | $Ni_{69.1}Cr_{8}Nb_{3.4}P_{18}Si_{1.5}$ | 5 |
| 29 | $Ni_{68.1}Cr_{9}Nb_{3.4}P_{18}Si_{1.5}$ | 7 |
| 30 | $Ni_{67.1}Cr_{10}Nb_{3.4}P_{18}Si_{1.5}$ | 10 |
| 31 | $Ni_{66.1}Cr_{11}Nb_{3.4}P_{18}Si_{1.5}$ | 10 |
| 32 | $Ni_{65.1}Cr_{12}Nb_{3.4}P_{18}Si_{1.5}$ | 6 |
| 33 | $Ni_{64.1}Cr_{13}Nb_{3.4}P_{18}Si_{1.5}$ | 5 |
| 34 | $Ni_{63.1}Cr_{14}Nb_{3.4}P_{18}Si_{1.5}$ | 4 |
| 35 | $Ni_{62.1}Cr_{15}Nb_{3.4}P_{18}Si_{1.5}$ | 4 |
| 36 | $Ni_{61.1}Cr_{16}Nb_{3.4}P_{18}Si_{1.5}$ | 3 |

Figure 11:
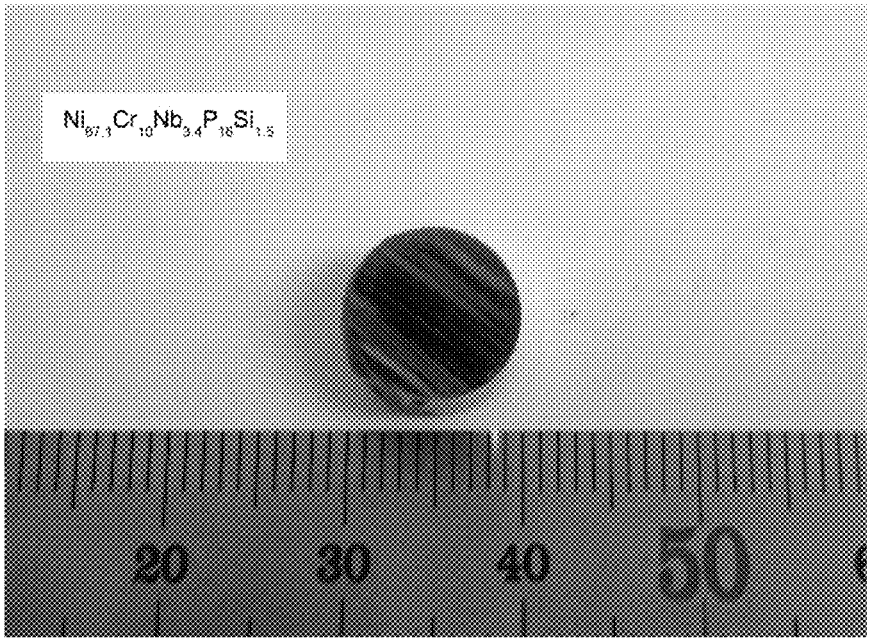
FIG. 11 provides an image of an amorphous 10 mm rod of example metallic glass $Ni_{67.1}Cr_{10}Nb_{3.4}P_{18}Si_{1.5}$.
Figure 12:
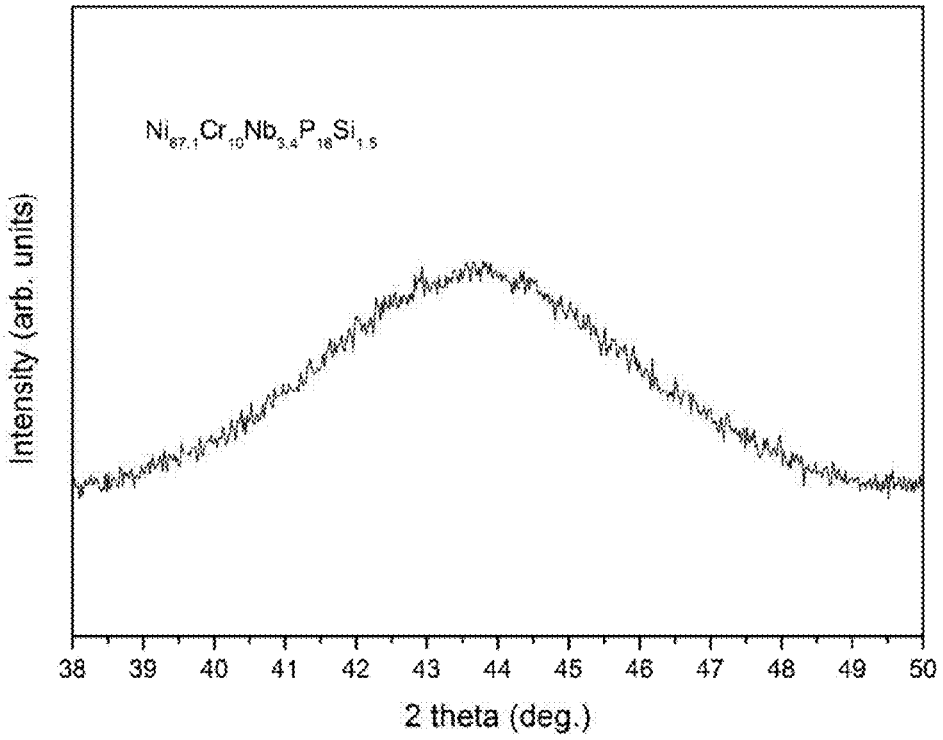
FIG. 12 provides an x-ray diffractogram verifying the amorphous structure of a 10 mm rod of example metallic glass $Ni_{67.1}Cr_{10}Nb_{3.4}P_{18}Si_{1.5}$, in accordance with embodiments of the disclosure.

Among the alloy compositions investigated in this disclosure, one of the alloys exhibiting the highest glass-forming ability is Example 30, having composition $Ni_{67.1}Cr_{10}Nb_{3.4}P_{18}Si_{1.5}$, which is capable of forming amorphous rods of up to 10 mm in diameter. An image of a 10 mm diameter amorphous $Ni_{67.1}Cr_{10}Nb_{3.4}P_{18}Si_{1.5}$ rod is shown in FIG. 11. An x-ray diffractogram taken on the cross section of a 10 mm diameter $Ni_{67.1}Cr_{10}Nb_{3.4}P_{18}Si_{1.5}$ rod verifying its amorphous structure is shown in FIG. 12.

Figure 13:
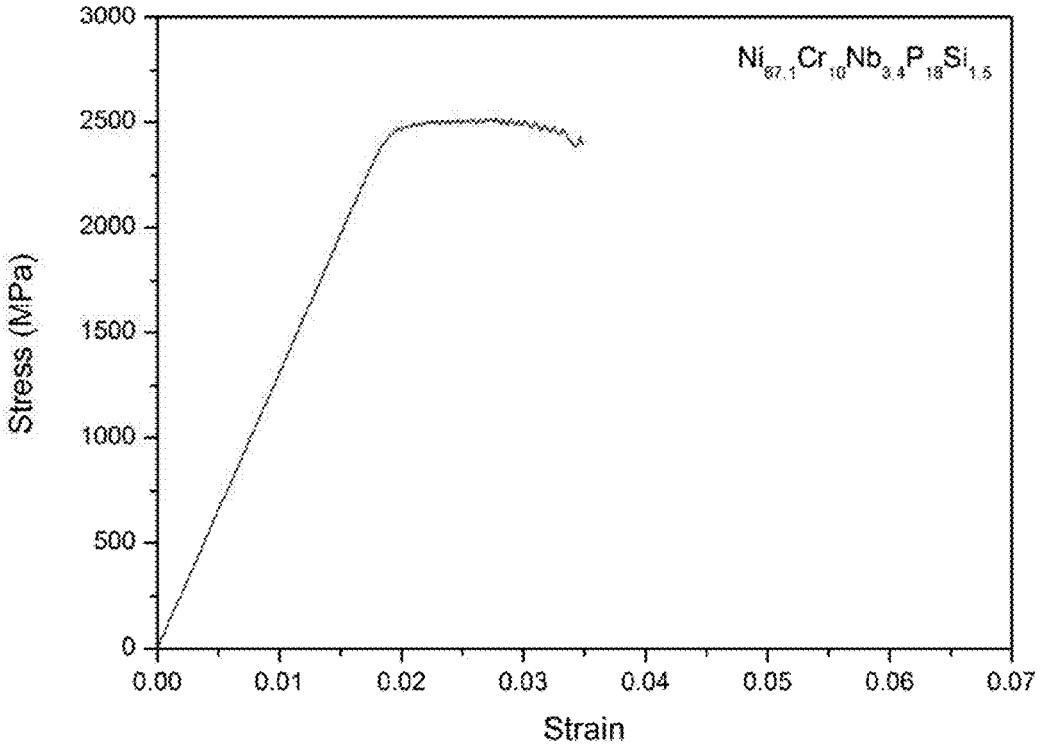
FIG. 13 provides a compressive stress-strain diagram for example metallic glass $Ni_{67.1}Cr_{10}Nb_{3.4}P_{18}Si_{1.5}$, in accordance with embodiments of the disclosure.

Compressive loading of metallic glass $Ni_{67.1}Cr_{10}Nb_{3.4}P_{18}Si_{1.5}$ was also performed to determine the compressive yield strength. The stress-strain diagram for sample metallic glass $Ni_{67.1}Cr_{10}Nb_{3.4}P_{18}Si_{1.5}$ is presented in FIG. 13.

Figure 14:
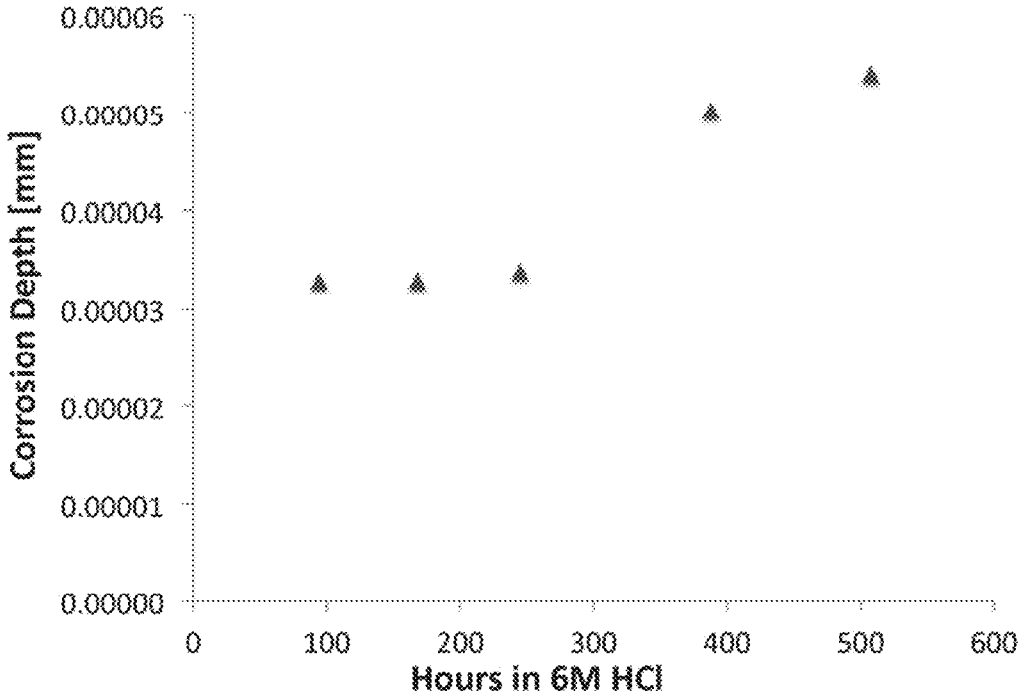
FIG. 14 provides a plot showing the corrosion depth versus time in a 6M HCl solution of a 3 mm metallic glass rod having composition $Ni_{67.1}Cr_{10}Nb_{3.4}P_{18}Si_{1.5}$, in accordance with embodiments of the disclosure.

The metallic glasses according to the disclosure also exhibit corrosion resistance. The corrosion resistance of example metallic glass $Ni_{67.1}Cr_{10}Nb_{3.4}P_{18}Si_{1.5}$ was evaluated by an immersion test in 6M HCl. A plot of the corrosion depth versus immersion time is presented in FIG. 14. The corrosion depth at approximately 508 hours is measured to be about 0.054 micrometers. The corrosion rate is estimated to be 0.52 μm/year.

Figure 15:
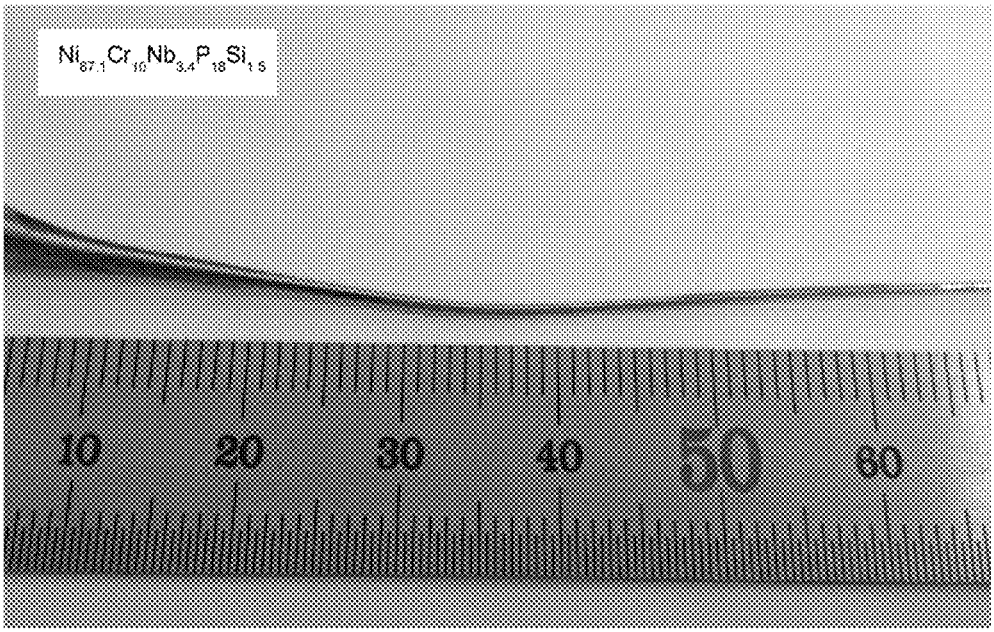
FIG. 15 provides an image of a plastically bent 1 mm amorphous rod of example metallic glass $Ni_{67.1}Cr_{10}Nb_{3.4}P_{18}Si_{1.5}$, in accordance with embodiments of the disclosure.

Lastly, the metallic glasses of the disclosure exhibit a remarkable bending ductility. Specifically, under an applied bending load, the alloys are capable of undergoing plastic bending in the absence of fracture for diameters up to at least 1 mm. An Image of a metallic glass rod of example metallic glass $Ni_{67.1}Cr_{10}Nb_{3.4}P_{18}Si_{1.5}$ plastically bent at 1-mm diameter section is presented in FIG. 15.

Various thermophysical, mechanical, and chemical properties for the alloy and metallic glass with composition $Ni_{67.1}Cr_{10}Nb_{3.4}P_{18}Si_{1.5}$ were investigated. Measured thermophysical properties include glass-transition, crystallization, solidus and liquidus temperatures, density, shear modulus, bulk modulus, Young's modulus, and Poisson's ratio. Measured mechanical properties include notch toughness and compressive yield strength. Measured chemical properties include corrosion resistance in 6M HCl. These properties are listed in Table 6.

TABLE 6

Thermophysical, Mechanical, and chemical properties for metallic glass $Ni_{67.1}Cr_{10}Nb_{3.4}P_{18}Si_{1.5}$.

| | |
|---|---|
| Composition | $Ni_{67.1}Cr_{10}Nb_{3.4}P_{18}Si_{1.5}$ |
| Critical rod diameter | 10 mm |
| Glass-transition temperature | 403° C. |
| Crystallization temperature | 451° C. |
| Solidus temperature | 842° C. |
| Liquidus temperature | 880° C. |
| Density | 7.91 g/cc |
| Yield strength (compressive) | 2500 MPa |
| Notch toughness | 78.6 ± 3.5 MPa $m^{1/2}$ |
| Plastic zone radius | 0.32 mm |
| Shear modulus | 50.8 GPa |
| Bulk modulus | 181.1 GPa |
| Young's modulus | 139.5 GPa |
| Poisson's ratio | 0.372 |
| Corrosion rate (6M HCl) | 0.52 μm/year |

For the metallic glasses according to the disclosure, the notch toughness is expected to be at least 60 MPa $m^{1/2}$, the compressive yield strength is expected to be at least 2400 MPa, the plastic zone radius is expected to be at least 0.3 mm, the shear modulus is expected to be not more than 52 GPa, the bulk modulus is expected to be at least 175 GPa, the Poisson's ratio is expected to be at least 0.36, the corrosion rate in 6M HCl is expected to be under 10 μm/year.

Description of Methods of Processing the Sample Alloys

A method for producing the alloy ingots involves inductive melting of the appropriate amounts of elemental constituents in a quartz tube under inert atmosphere. The purity levels of the constituent elements were as follows: Ni 99.995%, Cr 99.996% (single crystal), Nb 99.95%, P 99.9999% (red phosphorus), and Si 99.9999%. In some embodiments, the alloy ingots may include less than 1% B. In some embodiments, the alloy ingots may include less than 0.9% B. In some embodiments, the alloy ingots may include less than 0.8% B. In some embodiments, the alloy ingots may include less than 0.7% B. In some embodiments, the alloy ingots may include less than 0.6% B. In some embodiments, the alloy ingots may include less than 0.5% B. In some embodiments, the alloy ingots may include less than 0.4% B. In some embodiments, the alloy ingots may include less than 0.3% B. In some embodiments, the alloy ingots may include less than 0.2% B. In some embodiments, the alloy ingots may include less than 0.1% B. In some embodiments, the alloy ingots may include less than 0.09% B. In some embodiments, the alloy ingots may include less than 0.08% B. In some embodiments, the alloy ingots may include less than 0.07% B. In some embodiments, the alloy ingots may include less than 0.06% B. In some embodiments, the alloy ingots may include less than 0.05% B. In some embodiments, the alloy ingots may include less than 0.04% B. In some embodiments, the alloy ingots may include less than 0.03% B. In some embodiments, the alloy ingots may include less than 0.02% B. In some embodiments, the alloy ingots may include less than 0.01% B.

The alloy ingots may be fluxed with a reducing agent. In some embodiments, the reducing agent comprises boron and oxygen. In one embodiment, the reducing agent can be dehydrated boron oxide ($B_2O_3$). A method for fluxing the alloys of the disclosure involves melting the ingots and $B_2O_3$in a quartz tube under inert atmosphere, bringing the alloy melt in contact with the $B_2O_3$ melt and allowing the two melts to interact for at least 500 seconds, and in some embodiments 1500 seconds, at a temperature of at least 1100° C., and in some embodiments between 1200 and 1400° C., and subsequently quenching in a bath of room temperature water.

In some embodiments, metallic glass articles can be produced from the alloy of the disclosure by re-melting the fluxed alloy ingots, holding the melt at a temperature of about 1200° C. or higher, and in some embodiments between 1300 and 1400° C., under inert atmosphere, and rapidly quenching the melt. In some embodiments, quenching of the melt can be performed by injecting or pouring the melt into a metal mold. In certain embodiments, the metal mold can be made of copper, brass, or steel. In a particular embodiment, a method for producing metallic glass rods from the alloy ingots involves re-melting the fluxed ingots in quartz tubes of 0.5-mm thick walls in a furnace between 1300 and 1400° C. under high purity argon and rapidly quenching in a room-temperature water bath.

Test Methodology for Measuring Notch Toughness

The notch toughness of sample metallic glasses was performed on 3-mm diameter rods. The rods were notched using a wire saw with a root radius of between 0.10 and 0.13 μm to a depth of approximately half the rod diameter. The notched specimens were placed on a 3-point bending fixture with span distance of 12.7 mm and carefully aligned with the notched side facing downward. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Compressive Yield Strength

Compression testing of exemplary metallic glasses was performed on cylindrical specimens 3 mm in diameter and 6 mm in length by applying a monotonically increasing load at constant cross-head speed of 0.001 mm/s using a screw-driven testing frame. The strain was measured using a linear variable differential transformer. The compressive yield strength was estimated using the 0.2% proof stress criterion.

Test Methodology for Measuring Density and Moduli

The shear and longitudinal wave speeds were measured ultrasonically on a cylindrical metallic glass specimen 3 mm in diameter and about 3 mm in length using a pulse-echo overlap set-up with 25 MHz piezoelectric transducers. The density was measured by the Archimedes method, as given in the American Society for Testing and Materials standard C693-93. Using the density and elastic constant values, the shear modulus, bulk modulus, Young's modulus, and Poisson's ratio were estimated.

Test Methodology for Measuring Corrosion Resistance

The corrosion resistance of sample metallic glasses was evaluated by immersion tests in hydrochloric acid (HCl). A rod of metallic glass sample with initial diameter of 3.16 mm, and a length of 22.72 mm was immersed in a bath of 6M HCl at room temperature. The corrosion depth at various stages during the immersion was estimated by measuring the mass change with an accuracy of ±0.01 mg. The corrosion rate was estimated assuming linear kinetics.

The metallic glasses described herein can be valuable in the fabrication of electronic devices. An electronic device herein can refer to any electronic device known in the art. For example, it can be a telephone, such as a mobile phone, and a landline phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the embodiments disclosed herein. Accordingly, the above description should not be taken as limiting the scope of the document.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the disclosed methods and systems, which, as a matter of language, might be said to fall therebetween.

What is claimed:

1. An alloy capable of forming a metallic glass represented by the following formula (subscripts a, b, c, and d denote atomic percentages):

$$Ni_{(100-a-b-c-d)}Cr_aNb_bP_cSi_d,$$

where a is between 2 and 18, b is between 1 and 6, c is between 16 and 20, d is up to 4, wherein the alloy is entirely free of boron, and wherein the critical rod diameter of the alloy is at least 1 mm.

2. The alloy according to claim 1 where a is between 3 and 16, b is between 2 and 5, c is between 16.5 and 19.5, d is between 0 and 3, wherein the critical rod diameter of the alloy is at least 3 mm.

3. The alloy according to claim 1 where a is between 4 and 14, b is between 2.5 and 4.5, c is between 17.5 and 19, d is between 0.5 and 2.5, wherein the critical rod diameter of the alloy is at least 5 mm.

4. The alloy according to claim 1 where a is between 5 and 7, b is between 2.5 and 4.5, c is between 17.5 and 19, d is between 0.5 and 2.5, wherein the critical rod diameter of the alloy is at least 6 mm.

5. The alloy according to claim 1 where a is between 8 and 13, b is between 2.5 and 4.5, c is between 17.5 and 19, d is between 0.5 and 2.5, wherein the critical rod diameter of the alloy is at least 6 mm.

6. The alloy according to claim 1 where a is between 9 and 12, b is between 3 and 4, c is between 17.5 and 18.5, d is between 1 and 2, wherein the critical rod diameter of the alloy is at least 8 mm.

7. The alloy according to claim 1 where the sum of c and d is between 18.5 and 21, wherein the critical rod diameter of the alloy is at least 3 mm.

8. The alloy according to claim 7 where the sum of c and d is between 19 and 20, wherein the critical rod diameter of the alloy is at least 6 mm.

9. The alloy according to claim 1 where up to 30 atomic percent of Ni is substituted by Co.

10. The alloy according to claim 1 where up to 10 atomic percent of Ni is substituted by Fe.

11. The alloy according to claim 1 where up to 5 atomic percent of Ni is substituted by Cu.

12. The alloy according to claim 1 where up to 2 atomic percent of Cr is substituted by Mo, Mn, Fe, Co, W, Ru, Re, Cu, Pd, Pt, or combinations thereof.

13. The alloy according to claim 1 where up to 1 atomic percent of Nb is substituted by Mo, Mn, Ta, V, or combinations thereof.

14. A metallic glass comprising the alloy according to claim 1.

15. The metallic glass of claim 14 wherein the notch toughness of the metallic glass is at least 60 MPa $m^{1/2}$.

16. A method of producing the metallic glass of claim 14 comprising:

melting the alloy into a molten state; and quenching the melt at a cooling rate sufficiently rapid to prevent crystallization of the alloy.

17. The method of claim 16, further comprising fluxing the melt with a reducing agent prior to quenching.

18. The method of claim 17, wherein the reducing agent is boron oxide.

19. The method of claim 16, wherein the temperature of the melt prior to quenching is at least 1200° C.

20. The method of claim 16, wherein the temperature of the melt prior to quenching is at least 200° above the liquidus temperature of the alloy.

* * * * *